US008982108B2

(12) United States Patent
Lee et al.

(10) Patent No.: US 8,982,108 B2
(45) Date of Patent: Mar. 17, 2015

(54) DISPLAY DEVICE AND DRIVING METHOD THEREOF

(71) Applicant: Samsung Display Co., Ltd., Yongin, Gyeonggi-Do (KR)

(72) Inventors: Kyoung Won Lee, Yongin-si (KR); Seung Seok Nam, Yongin-si (KR); Cheol Woo Park, Suwon-si (KR); Kyoung Ho Lim, Yongin-si (KR); Dae-Gwang Jang, Incheon (KR); Gi Geun Kim, Seoul (KR); Eun Ho Lee, Suwon-si (KR); Ung Gyu Min, Seoul (KR); Seok Ha Hong, Yongin-si (KR)

(73) Assignee: Samsung Display Co., Ltd. (KR)

( * ) Notice: Subject to any disclaimer, the term of this patent is extended or adjusted under 35 U.S.C. 154(b) by 195 days.

(21) Appl. No.: 13/691,365

(22) Filed: Nov. 30, 2012

(65) Prior Publication Data

US 2014/0022220 A1 Jan. 23, 2014

(30) Foreign Application Priority Data

Jul. 18, 2012 (KR) ..... 10-2012-0078429

(51) Int. Cl.
*G09G 3/20* (2006.01)

(52) U.S. Cl.
CPC ..... *G09G 3/20* (2013.01)
USPC ..... 345/204

(58) Field of Classification Search
CPC ..... G09G 2320/10; G09G 2320/103; G09G 2320/106; G09G 2340/16
USPC ..... 345/204–215; 382/166, 232, 236
See application file for complete search history.

(56) References Cited

U.S. PATENT DOCUMENTS

| | | | | |
|---|---|---|---|---|
| 7,734,108 | B2 | 6/2010 | Oura | |
| 7,782,281 | B2 | 8/2010 | Oh et al. | |
| 8,150,164 | B2 | 4/2012 | Oh et al. | |
| 2004/0258312 | A1 | 12/2004 | Sim | |
| 2005/0062681 | A1* | 3/2005 | Honbo | 345/10 |
| 2008/0007514 | A1* | 1/2008 | Tanaka | 345/102 |
| 2010/0060554 | A1 | 3/2010 | Koh et al. | |
| 2011/0262037 | A1* | 10/2011 | Ohnishi et al. | 382/166 |

FOREIGN PATENT DOCUMENTS

| | | | |
|---|---|---|---|
| JP | 2008028611 | A | 2/2008 |
| JP | 2008033066 | A | 2/2008 |
| KR | 1020050112571 | A | 12/2005 |

(Continued)

*Primary Examiner* — Alexander Eisen
*Assistant Examiner* — Abhishek Sarma
(74) *Attorney, Agent, or Firm* — Cantor Colburn LLP

(57) ABSTRACT

A display device including: a display panel; and a signal controller which controls signals for driving the display panel, where the signal controller includes a representative value generator which sequentially operates a portion of image data of one frame, where the representative value generator moves a last position digit into another position digit of the portion of the image data and generates a representative value representing a portion of a frame image corresponding to the portion of the image data; a storage portion which stores the representative value therein; and a comparator which compares the representative values of present and prior frames to determine whether the portion of the frame image is a still image or a motion picture, and the signal controller controls the signals for driving the display panel such that a driving frequency for the still image is lower than a driving frequency for the motion picture.

20 Claims, 13 Drawing Sheets
(2 of 13 Drawing Sheet(s) Filed in Color)

(56) References Cited

FOREIGN PATENT DOCUMENTS

| | | | |
|---|---|---|---|
| KR | 100590326 | B1 | 6/2006 |
| KR | 1020060083041 | A | 7/2006 |
| KR | 1020080002427 | A | 1/2008 |
| KR | 1020110071384 | A | 6/2011 |
| KR | 1020140011701 | A | 1/2014 |

* cited by examiner

DISPLAY DEVICE AND DRIVING METHOD THEREOF

This application claims priority to Korean Patent Application No. 10-2012-0078429 filed on Jul. 18, 2012, and all the benefits accruing therefrom under 35 U.S.C. §119, the content of which in its entirety is herein incorporated by reference.

BACKGROUND (a) Field

Exemplary embodiments of the invention relate to a display device and a driving method thereof. More particularly, exemplary embodiments of the invention relate to a display device with reduced power consumption and a driving method thereof.

(b) Description of the Related Art

Currently, display devices are widely used in computer monitors, televisions, mobile phones and the like. The display device typically includes a cathode ray tube display device, a liquid crystal display, a plasma display device and the like, for example.

The display device includes a signal controller and a display panel. The signal controller receives an image data of an image to be displayed on the display panel from the outside, generates a control signal for driving the display panel, and transfers the control signal together with the image data to the display panel to drive the display device.

The image displayed by the display panel may be classified into a still image and a motion picture. The display panel displays several frames per one second, and in this case, when the image data of each frame are the same as each other, the still image is displayed. If the image data of each frame are different from each other, the motion picture is displayed.

Driving of the display panel may be performed in different manners when the still image is displayed and the motion picture is displayed to reduce a power consumption of the display device. Accordingly, an image may be determined as one of the still image and the motion picture.

A method of comparing the image data of all pixels of a prior frame and the image data of all pixels of a present frame to determine whether the image data are changed or not has been proposed to discriminate between the still image and the motion picture. In such a method, a memory for storing the image data of all pixels of the prior frame may be added such that power consumption is increased.

SUMMARY

The invention has been made in an effort to provide a display device that can reduce power consumption and a driving method thereof.

An exemplary embodiment of the invention provides a display device including: a display panel; and a signal controller which controls signals for driving the display panel, where the signal controller includes a representative value generator which sequentially operates at least a portion of image data of one frame, where the representative value generator moves a last position digit into another position digit of the at least a portion of the image data of the one frame and generates a representative value representing at least a portion of a frame image corresponding to the at least a portion of the image data of the one frame; a storage portion which stores the representative value therein; and a comparator which compares the representative value of a present frame and the representative value of a prior frame to determine whether the at least a portion of the frame image is a still image or a motion picture, and the signal controller controls the signals for driving the display panel such that a driving frequency when the at least a portion of the frame image is the still image is lower than a driving frequency when at least the portion of the frame image is the motion picture.

In an exemplary embodiment, the representative value generator may include an operator which sequentially generates a middle value based on the at least a portion of the image data of the one frame; and a converter which moves a last position digit of the middle value to a first position digit to generate a changed value, and transfers the changed value to the operator, where the operator may generate the middle value using the changed value transferred from the converter based on the at least a portion of the image data of the one frame, the operator may perform at least one of an addition and a subtraction, and the converter may output the changed value as the representative value when an operation of the operator is completed.

In an exemplary embodiment, the representative value generator may further include a random number generator which generates a random number; and a data converter which generates converted image data by combining input image data received from outside with the random number, and the operator generates the middle value based on the converted image data.

In an exemplary embodiment, the random number generator may generate the random number using a linear feedback shift register.

In an exemplary embodiment, the random number generator may generate a first random number by moving an output value obtained by inputting last two position digits of a predetermined number to an exclusive OR gate to a first position digit of the predetermined number, and deleting a last position digit of the predetermined number, and the random number generator may generate a second random number by moving an output value obtained by inputting the last two position digits of the first random number to an exclusive OR gate to a first position digit of the first random number, and deleting a last position digit of the first random number.

In an exemplary embodiment, the random number generator may generate a plurality of random numbers having the same number of position digits as the input image data.

In an exemplary embodiment, the data converter may generate the converted image data using an output value obtained by inputting each position digit of the at least a portion of the input image data and each position digit of the random number to the exclusive OR gate.

In an exemplary embodiment, two random numbers used to generate the converted image data of two adjacent pixels in a same frame may have different values, and two random numbers used to generate the converted image data of a same pixel in two adjacent frames may have a same value.

In an exemplary embodiment, the signal controller may further include a switching portion which is turned on when the at least the portion of the frame image is the motion picture.

In an exemplary embodiment, at least a portion of the image data of the one frame may correspond to one line of the frame image or an entire of the frame image.

Another exemplary embodiment of the invention provides a driving method of a display device, which includes: generating a first representative value representing at least a portion of a frame image corresponding to at least a portion of image data of a first frame by sequentially operating based on the at least a portion of image data of the first frame and moving a last position digit into another position digit; storing the first representative value; generating a second representative value representing at least a portion of the frame image corresponding to at least a portion of image data of a second frame by sequentially operating based on the at least a portion of image data of the second frame and moving the last position digit into another position digit; and determining the at least a portion of the frame image to be a still image when the first representative value and the second representative value are the same as each other and determining the at least a portion of the frame image to be a motion picture when the first representative value and the second representative value are different from each other by comparing the first representative value and the second representative value to each other, where a driving frequency of the display device when the at least a portion of the frame image is the still image is controlled to be lower than a driving frequency of the display device when the at least a portion of the frame image is the motion picture.

In an exemplary embodiment, each of the generating the first representative value and the generating the second representative value may include: moving the last position digit into a first position digit; and performing at least one of an addition and a subtraction.

In an exemplary embodiment, each of the generating the first representative value and the generating the second representative value may further include: generating a random number; and generating converted image data by combining the at least a portion of image data with the random number.

In an exemplary embodiment, the generating the random number may include using a linear feedback shift register.

In an exemplary embodiment, the generating the random number may include: generating a first random number by moving an output value obtained by inputting last two position digits of a predetermined number to an exclusive OR gate to a first position digit of the predetermined number, and deleting a last position digit of the predetermined number; and generating a second random number by moving an output value obtained by inputting last two position digits of the first random number to an exclusive OR gate to a first position digit of the first random number, and deleting a last position digit of the first random number.

In an exemplary embodiment, the generating the random number may include generating a plurality of random numbers, where the random numbers have the same number of position digits as the input image data.

In an exemplary embodiment, the generating the converted image data may include obtaining an output value by inputting each position digit of the input image data and each position digit of the random number to the exclusive OR gate.

In an exemplary embodiment, two random numbers used to generate the converted image data of two adjacent pixels may have different values, and two random numbers used to generate the converted image data of a same pixel in two adjacent frames may have a same value.

In an exemplary embodiment, the driving method may further include: outputting the image data of the second frame when the at least a portion of the frame image is the motion picture.

In an exemplary embodiment, the at least a portion of the image data may correspond to one line of the frame image or an entire of the frame image.

In one or more exemplary embodiment of the display device and the driving method thereof, a representative value that represents a portion or an entire of a frame image corresponding to image data of one frame is generated, the representative value is stored, and the representative value of a prior frame and the representative value of a present frame are compared to determine whether the frame image is a still image or a motion picture, thus substantially reducing a size of a memory to reduce power consumption.

In one or more exemplary embodiment, the representative value is generated such that the representative value is distributed with random probability, and it is determined whether the frame image is the still image or the motion picture with substantially improved accuracy.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other features of the invention will become more apparent by describing in further detail exemplary embodiments thereof with reference to the accompanying drawings, in which.

DETAILED DESCRIPTION

Figure 1:
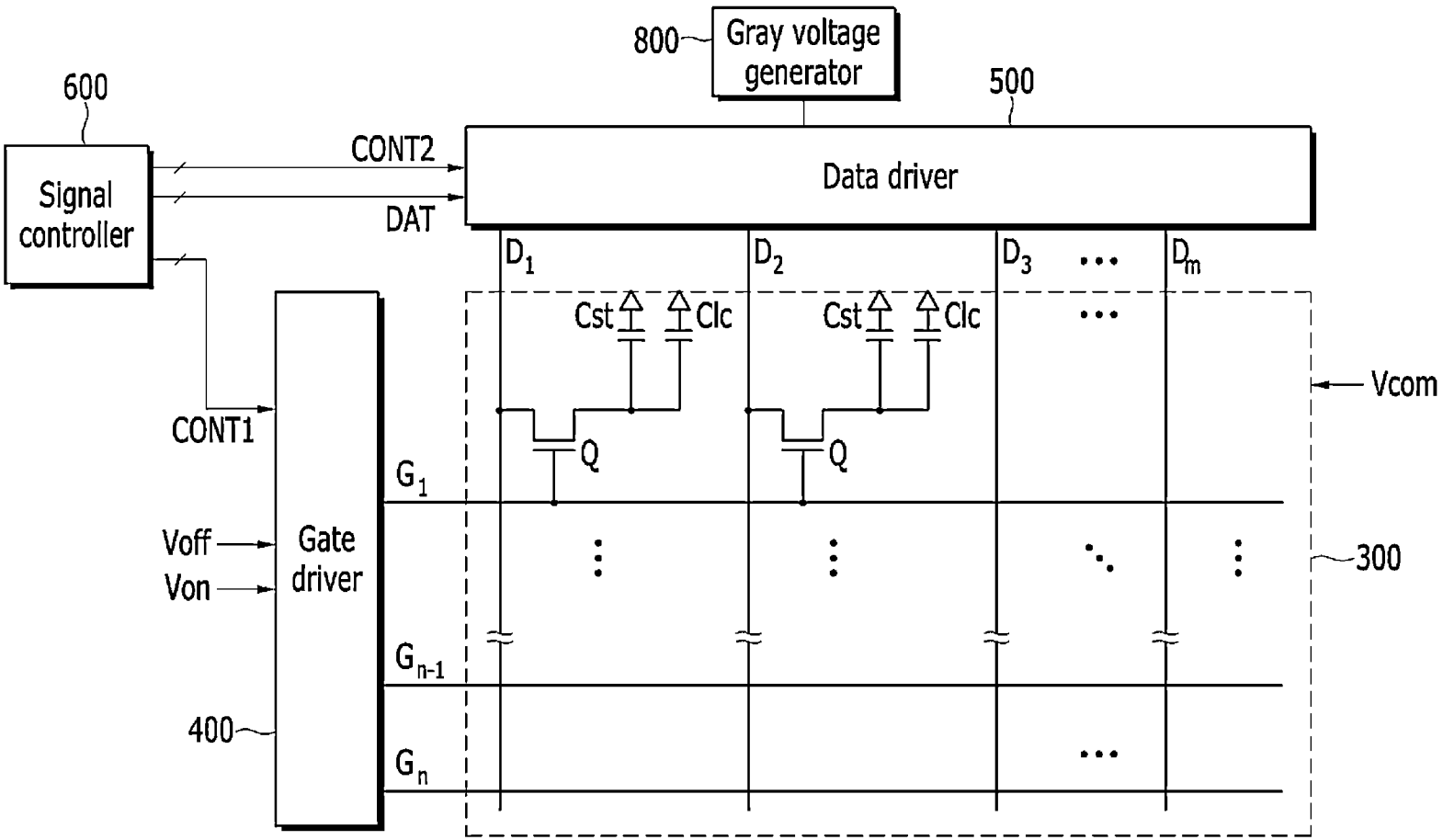
FIG. 1 is a block diagram showing an exemplary embodiment of a display device according to the invention.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of a display device according to the invention will be described with reference to the accompanying drawings.

FIG. 1 is a block diagram showing an exemplary embodiment of a display device according the invention.

An exemplary embodiment of the display device according to the invention, as shown in FIG. 1, includes a display panel 300 that displays an image and a signal controller 600 that controls signals for driving the display panel 300.

The display panel 300 may display a still image and a motion picture based on image data DAT outputted from the signal controller 600. When a plurality of consecutive frames have the same image data DAT, the still image is displayed, and when the frames have the different image data DAT, the motion picture is displayed.

The display panel 300 includes a plurality of gate lines G1-Gn and a plurality of data lines D1-Dm. In an exemplary embodiment, the gate lines G1-Gn extend substantially in a horizontal direction, and the data lines D1-Dm cross the gate lines G1-Gn and extend substantially in a vertical direction.

A gate line G1-Gn and a data line D1-Dm are connected to a pixel, and the pixel includes a switching element Q connected to the gate line G1-Gn and the data line D1-Dm. A control terminal of the switching element Q is connected to the gate line G1-Gn, an input terminal of the switching element Q is connected to the data line D1-Dm, and an output terminal of the switching element Q is connected to a liquid crystal capacitor Clc and a storage capacitor Cst.

In an exemplary embodiment, as shown in FIG. 1, the display panel 300 is a liquid crystal panel, but not being limited thereto. In an alternative exemplary embodiment, the display panel 300 may be one of various display panels such as an organic light emitting panel, an electrophoretic display panel and a plasma display panel, for example.

The signal controller 600 receives image data DAT and control signal, for example, a vertical synchronization signal, a horizontal synchronizing signal, a main clock signal and a data enable signal, from outside, and generates and outputs a gate control signal CONT1 and a data control signal CONT2 in response to the image data and the control signal based on an operation condition of the liquid crystal panel 300.

The gate control signal CONT1 includes a vertical synchronization start signal for instructing a start of an output of a gate-on pulse (e.g., a high level portion of the gate signal) and a gate clock signal for controlling an output time of the gate-on pulse.

The data control signal CONT2 includes a horizontal synchronization start signal for instructing a start of an input of the image data DAT, a load signal for applying the corresponding data voltage to the data lines D1-Dm.

An exemplary embodiment of the display device according to the invention may further include a gate driver 400 that drives the gate lines G1-Gn and a data driver 500 that drives the data lines D1-Dm.

The gate lines G1-Gn of the display panel 300 are connected to the gate driver 400, and the gate driver 400 alternately applies the gate-on voltage Von and the gate-off voltage Voff to the gate lines G1-Gn based on the gate control signal CONT1 applied from the signal controller 600.

The display panel 300 may include two substrates coupled to each other, e.g., bonded together, while facing each other, and the gate driver 400 may be disposed on, e.g., attached to, an edge portion of one side of the display panel 300. In an exemplary embodiment, the gate driver 400, the gate lines G1-Gn, the data lines D1-Dm and the switching element Q may be collectively disposed on the display panel 300. In such an embodiment, the gate driver 400 may be provided in a process of providing the gate lines G1-Gn, the data lines D1-Dm and the switching element Q.

The data lines D1-Dm of the display panel 300 are connected to the data driver 500, and the data driver 500 receives the data control signal CONT2 and the image data DAT from the signal controller 600. The data driver 500 converts the image data DAT into a data voltage using a gray voltage generated in a gray voltage generator 800, and transfers the data voltage to the data lines D1-Dm.

Figure 2:
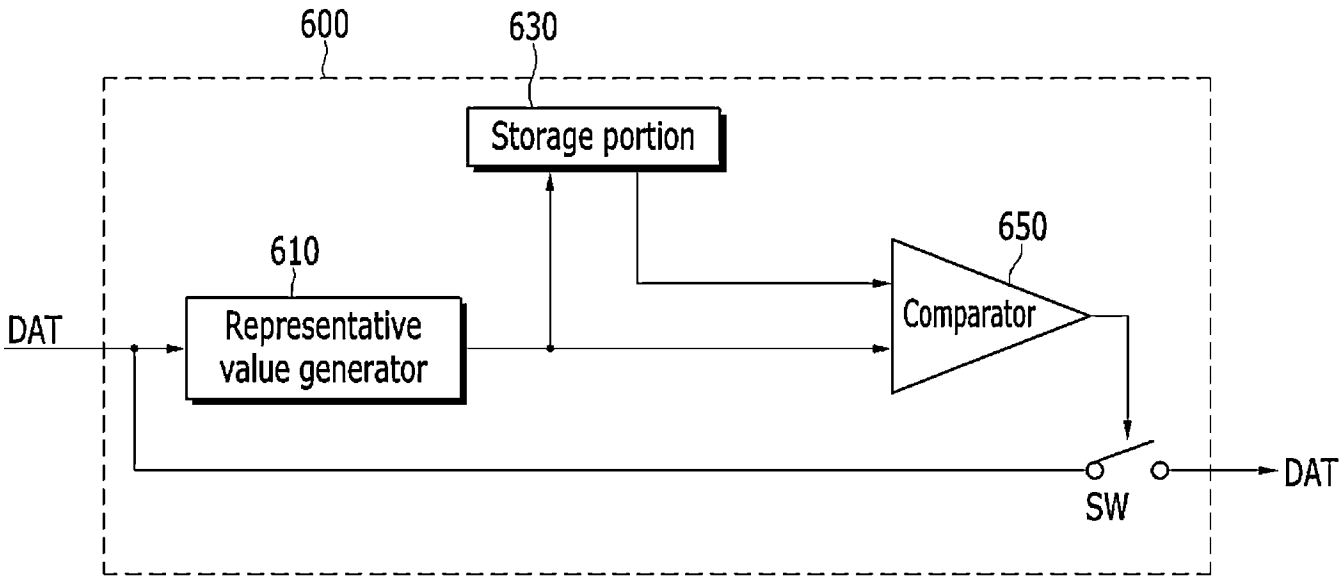
FIG. 2 is a block diagram showing an exemplary embodiment of a signal controller of the display device according to the invention.
Figure 3:
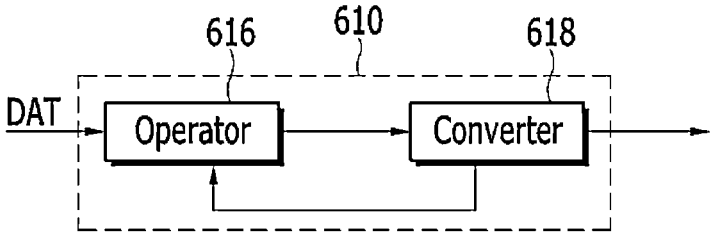
FIG. 3 is a block diagram showing an exemplary embodiment of a representative value generator of the signal controller of the display device according to the invention.

Referring to FIGS. 2 and 3, an exemplary embodiment of the signal controller of the display device according to the invention will hereinafter be described.

FIG. 2 is a block diagram showing an exemplary embodiment of a signal controller of the display device according to the invention, and FIG. 3 is a block diagram showing an exemplary embodiment of a representative value generator of the signal controller of the display device according to the invention.

Referring to FIG. 2, the signal controller 600 includes a representative value generator 610 that receives the image data DAT of one frame corresponding to an image of the one frame (hereinafter, will be referred to as a "frame image") and generates a representative value that represents at least a portion of the frame image, a storage portion 630 that stores the representative value therein, and a comparator 650 which determines whether at least a portion of the frame image corresponding to the at least a portion of the image data DAT of the one frame is a still image or a motion picture.

The representative value generator 610 sequentially adds the at least a portion of the image data DAT among the image data DAT of the one frame and changes a last position digit into another position digit whenever the image data are added, thereby generating the representative value that represents the at least a portion of the frame image of the one frame.

In an exemplary embodiment, at least a portion of the frame image may be one line, a plurality of lines, or an entire of the frame image of one frame. In one exemplary embodiment, for example, at least a portion of the frame image is one line of the frame image, e.g., a portion of the frame image displayed by pixels in one pixel column or one pixel row, and the representative value generator 610 may sequentially add the image data DAT corresponding to the one line among the image data DAT of the one frame to generate the representative value that represents the one line. In an alternative exemplary embodiment, at least a portion represents three lines of the image of one frame, and the representative value generator 610 may sequentially add the image data DAT corresponding to the three lines to generate the representative value that represents the three lines. In another alternative exemplary embodiment, at least a portion represents an entire of the image of one frame, the representative value generator 610 may sequentially add an entire of the image data DAT of the one frame to generate the representative value that represents the entire of the image of the one frame. In the exemplary embodiments described above, the at least a portion is one of a portion or an entire of the frame image of the one frame, e.g., one line, a plurality of lines and an entire of the frame image of the one frame, but not being limited thereto. In an exemplary embodiment, the at least a portion may represent various portions of the frame image of the one frame.

In an exemplary embodiment, another position digit, to which the last position digit is changed, may be a first position digit. In one exemplary embodiment, for example, if 1 corresponding to the last position digit of 101101 is changed into the first position digit, 101101 becomes 110110, but not being limited thereto. The another position digit, to which the last position digit is changed, means a position digit other than the last position digit, and the another position digit is not limited to the first position digit, but may be various position digits other than the last position digit.

Referring to FIG. 3, the representative value generator 610 includes an operator 616 that sequentially adds the image data DAT to generate a middle value, and a converter 618 that changes the last position digit of the middle value into another position digit to generate a changed value.

The operator 616 sequentially receives at least a portion of the image data DAT and performs an addition. In one exemplary embodiment, for example, where the at least a portion corresponds to one line and one line includes 680 image data DAT, the operator 616 sequentially receives the 680 image data DAT. A first data of the 680 image data DAT and a second data of the 680 image data DAT are added to generate a first middle value, and the first middle value is transferred to the converter 618. A first changed value, which is the changed value of the first middle value, is inputted from the converter 618, a third data of the 680 image data DAT are added to the first changed value to generate a second middle value, and the second middle value is transferred to the converter 618. A second changed value, which is the changed value of the second middle value, is inputted from the converter 618, a fourth data of the 680 image data DAT are added to the second changed value to generate a third middle value, and the third middle value is transferred to the converter 618. The 680 image data DAT are sequentially added by the above-described method to generate a 679th middle value.

In an exemplary embodiment, the image data DAT are sequentially added to generate the middle value, but the invention is not limited thereto. In an alternative exemplary embodiment, the middle value may be generated by various operations, and the operation may be performed by an addition, a subtraction, combination of the addition and the subtraction and the like. In one exemplary embodiment, for example, the operator 616 may sequentially receive at least a portion of the image data DAT, and perform the subtraction. In an alternative exemplary embodiment, the operator 616 may sequentially receive at least a portion of the image data DAT, and alternately perform the addition and the subtraction. In another alternative exemplary embodiment, the addition may be performed for odd numbered image data DAT, and the subtraction may be performed for even numbered image data DAT.

The converter 618 sequentially receives a plurality of middle values from the operator 616. The converter 618 moves the last position digit of the inputted middle value to another position digit to generate the changed value, and transfers the generated changed value to the operator 616 again. In one exemplary embodiment, for example, the first middle value may be transferred from the operator 616, and the last position digit of the first middle value may be moved to the first position digit to generate the first changed value, and the first changed value is transferred to the operator 616. The second middle value may be transferred from the operator 616, and the last position digit of the second middle value may be moved to the first position digit to generate the second changed value, and the second changed value is transferred to the operator 616. The third middle value may be transferred from the operator 616, and the last position digit of the third middle value may be moved to the first position digit to generate the third changed value, and the third changed value is transferred to the operator 616. In such an embodiment, 679 middle values are sequentially changed by the above-described method to generate 679 changed values.

The converter 618 changes the 679th middle value, which is the last middle value, to generate a 679th changed value, and then outputs the 679th changed value as the representative value. In such an embodiment, the converter 618 outputs the changed value of the last middle value as the representative value when the operator 616 completely adds the at least a portion of the image data DAT.

Referring again to FIG. 2, the storage portion 630 receives the representative value from the representative value generator 610 and stores the representative value.

The storage portion 630 may store a plurality of representative values. In one exemplary embodiment, for example, where the representative value generator 610 generates the representative value of the image data DAT of one line and one frame includes 480 lines, the storage portion 630 may receive 480 representative values representing the 480 lines from the representative value generator 610 and store the 480 representative values. In an alternative exemplary embodiment, where the representative value generator 610 generates the representative value of the image data DAT of three lines and one frame includes 480 lines, the storage portion 630 may receive 160 representative values corresponding to 160 regions of the frame image of one frame, each of which is defined by three lines, from the representative value generator 610 and store the 160 representative values.

In another alternative exemplary embodiment, the storage portion 630 may store a single representative value. In one exemplary embodiment, for example, the representative value generator 610 may generate the representative value of the entire of the image data DAT of one frame, such that the storage portion 630 stores the single representative value.

In a conventional display device, an entire image data DAT of one frame are stored to compare the image data DAT of all pixels of the present frame to the image data DAT of all pixels of the prior frame. Accordingly, a memory having a large capacity is included to store the entire image data DAT of one frame. In an exemplary embodiment of display device according to the invention, the representative value corresponding to a portion of the image data DAT is stored, such that a memory having a relatively small capacity may be used.

The comparator 650 compares the representative value of the present frame and the representative value of the prior frame to determine whether the image of the region of the frame image represented by the representative value is the still image or the motion picture.

The comparator 650 receives the representative value of the present frame from the representative value generator 610, and receives the representative value of the prior frame from the storage portion 630. In such an embodiment, the representative value generator 610 generates the representative value and outputs the representative value to the storage portion 630 and the comparator 650. The storage portion 630 outputs the representative value of the prior frame to the comparator 650, and receives the representative value of the present frame from the representative value generator 610.

The comparator 650 compares the representative value of the present frame and the representative value of the prior frame, and determines the image of the region represented by the representative value to be the still image when the two values are the same as each other, and the comparator 650 determines the image of the region represented by the representative value to be the motion picture when the two values are different from each other.

In an exemplary embodiment, the signal controller 600 of the display device may control a driving frequency based on the determination of the comparator 650. The signal controller 600 may control the driving frequency when the still image is displayed to be lower than the driving frequency when the motion picture is displayed. In one exemplary embodiment, for example, driving may be performed at the driving frequency of about 60 hertz (Hz) when the motion picture is displayed, and driving may be performed at the driving frequency of about 10 Hz when the still image is displayed.

The signal controller 600 may control the driving frequency for each region. In one exemplary embodiment, for example, where the representative value is generated for each line of the frame image, the motion picture and the still image may be discriminated for each line, such that the driving frequency of each line may be controlled. In such an embodiment, different driving frequencies may be set for the portion where the image data DAT are changed and the portion where the image data DAT are not changed.

In an exemplary embodiment, the signal controller 600 of the display device may further include a switch SW. A control end of the switch SW is connected to the comparator 650, an output end of the switch SW is connected to the data driver 500 (shown in FIG. 1), and the image data DAT are inputted to an input end of the data driver.

The switch SW may be in an on-state to output the image data DAT when the image is determined to be the motion picture based on a result of comparison by the comparator 650.

The switch SW may be in an off-state not to output the image data DAT when the image is determined to be the still image based the result of comparison by the comparator 650. In an exemplary embodiment, when a region continuously displays the still image, the image data DAT are not outputted to the data driver 500 until the motion picture is displayed.

In an alternative exemplary embodiment, when the image is determined to be the still image, the switch SW may output the image data DAT every predetermined period. In such an embodiment, where the region is determined to continuously display the still image during the period of 10 frames, the switch SW may be in an on-state to output the image data DAT, but not being limited thereto. In an alternative exemplary embodiment, a predetermined driving frequency may be set when the still image is displayed, and the switch SW may be in an on-state to output the image data DAT when a period, during which the still image is continuously outputted, is equal to or greater than a predetermined period.

Next, referring again to FIGS. 1 to 3, an exemplary embodiment of the driving method of the display device according to the invention will be described.

First, the signal controller 600 sequentially receives the image data DAT of one frame. In one exemplary embodiment, for example, the image data DAT of Table 1 may be sequentially applied to the signal controller 600.

Table 1 shows a portion of the image data DAT of one frame and a middle value and a converted value thereof. A plurality of image data DAT shown in Table 1 is the image data DAT of a same line. That is, Table 1 shows a portion of the image data DAT sequentially inputted to one line during the one frame.

TABLE 1

| Image data DAT | Middle value | Converted value |
|---|---|---|
| — | — | 1000110010010001 |
| 101101 | 1000110010111110 | 0100011001011111 |
| 110010 | 0100011010010001 | 1010001101001000 |
| 010101 | 1010001101011101 | 1101000110101110 |

In an exemplary embodiment, the representative value generator 610 of the signal controller 600 sequentially adds the image data DAT of one line and changes the last position digit into another position digit whenever the addition is performed to generate a representative value of one line.

In such an embodiment, the operator 616 of the representative value generator 610 sequentially receives the image data DAT of one line to perform the addition, thus generating the middle value. The converter 618 of the representative value generator 610 receives the middle value, moves the last position digit into another position digit to generate the converted value, and applies the converted value to the operator 616.

In one exemplary embodiment, for example, when the image data DAT of 101101 are inputted to the operator 616 and the converted value generated by the image data DAT inputted before that is 1000110010010001, the operator 616 adds 101101 to 1000110010010001, thereby generating 1000110010111110 as the middle value. The last position digit of the generated middle value is zero (0). The converter 618 may move zero (0) that is the last position digit to the first position digit, thereby generating 0100011001011111 as the converted value.

In an exemplary embodiment, the image data DAT of 110010 are inputted to the operator 616, and 0100011001011111 that is the converted value generated based on the image data DAT prior thereto. The operator 616 adds 110010 to 0100011001011111, thereby generating 0100011010010001 as the middle value. The last position digit of the generated middle value is 1. The converter 618 may move 1 that is the last position digit to the first position digit, thereby generating 1010001101001000 as the converted value.

In an exemplary embodiment, the image data DAT of 010101 are inputted to the operator 616, and 1010001101001000 that is the converted value generated based on the image data DAT prior thereto. The operator 616 adds 010101 to 1010001101001000, thereby generating 1010001101011101 as the middle value. The last position digit of the generated middle value is 1. The converter 618 may move 1 that is the last position digit to the first position digit, thereby generating 1101000110101110 as the converted value.

If 010101 that is the inputted image data DAT is the last data of the image data DAT of one line, 1101000110101110 that is the converted value finally generated by the converter 618 of the representative value generator 610 is outputted as the representative value.

In an exemplary embodiment, the representative value generator 610 sequentially adds the image data DAT of the next line and changes the last position digit into the first position digit whenever the addition is performed to generate the representative value. The representative value generator 610 generates each of the representative values of the entire lines constituting a frame image of the one frame by the above-described manner.

In an exemplary embodiment, the representative value generator 610 transfers the generated representative value to the storage portion 630, and the storage portion 630 stores the representative values of each line constituting the frame image of the one frame.

In an exemplary embodiment, the representative value generator 610 sequentially receives the image data DAT of the next frame to generate the representative values of each line constituting the frame image of the one frame by the above-described manner.

In an exemplary embodiment, the representative value generator 610 outputs the generated representative values to the comparator 650, and at the same time, the representative values are stored in the storage portion 630. The storage portion 630 outputs the stored representative values to the comparator 650.

In such an embodiment, the representative values outputted to the comparator 650 by the storage portion 630 are the representative values of each line of the frame image of the prior frame, and the representative values outputted to the comparator 650 by the representative value generator 610 are the representative values of each line of the frame image of the present frame.

In an exemplary embodiment, the comparator 650 compares the representative value of each line of the frame image of the prior frame inputted from the storage portion 630 and the representative value of each line of the frame image of the present frame inputted from the representative value generator 610 to each other. In such an embodiment, the representative value of the prior frame and the representative value of the present frame are compared for each line of the frame image.

Based on a result of comparison, in an exemplary embodiment, when the representative value of the prior frame is the same as the representative value of the present frame, the image of the corresponding line is determined to be the still image. In such an embodiment, when the representative value of the prior frame is different from the representative value of the present frame, the image of the corresponding line is determined to be the motion picture.

In an exemplary embodiment, in the case where the image of the corresponding line displays the motion picture, the switch SW is in an on-state to output the image data DAT. In the case where the image of the corresponding line displays the still image, the switch SW is in an off-state not to output the image data DAT.

In an exemplary embodiment, when the image of the corresponding line is the still image, the image data DAT may be set not to be outputted. In an alternative exemplary embodiment, when the image of the corresponding line continuously is the still image during a predetermined period, the switch SW may be set to be in an on-state, thus outputting the image data DAT.

In an exemplary embodiment the driving frequency may be adjusted by setting the switch SW using various methods. In an exemplary embodiment, the driving frequency when the still image is displayed is controlled to be lower than the driving frequency when the motion picture is displayed.

In an exemplary embodiment, the still image or the motion picture is determined for each line of the frame image by generating the representative value representing one line of the frame image, but the invention is not limited thereto. In an alternative exemplary embodiment, the representative value representing a portion or an entire of the frame image may be generated. In one exemplary embodiment, for example, the representative value representing the entire of the frame image of one frame may be generated, or the representative value representing a plurality of lines of the frame image of one frame may be generated.

Next, referring to FIGS. 4 and 5, a difference between the representative values of the two adjacent frames in a comparative embodiment and an exemplary embodiment of the display device will be described.

Figure 4:
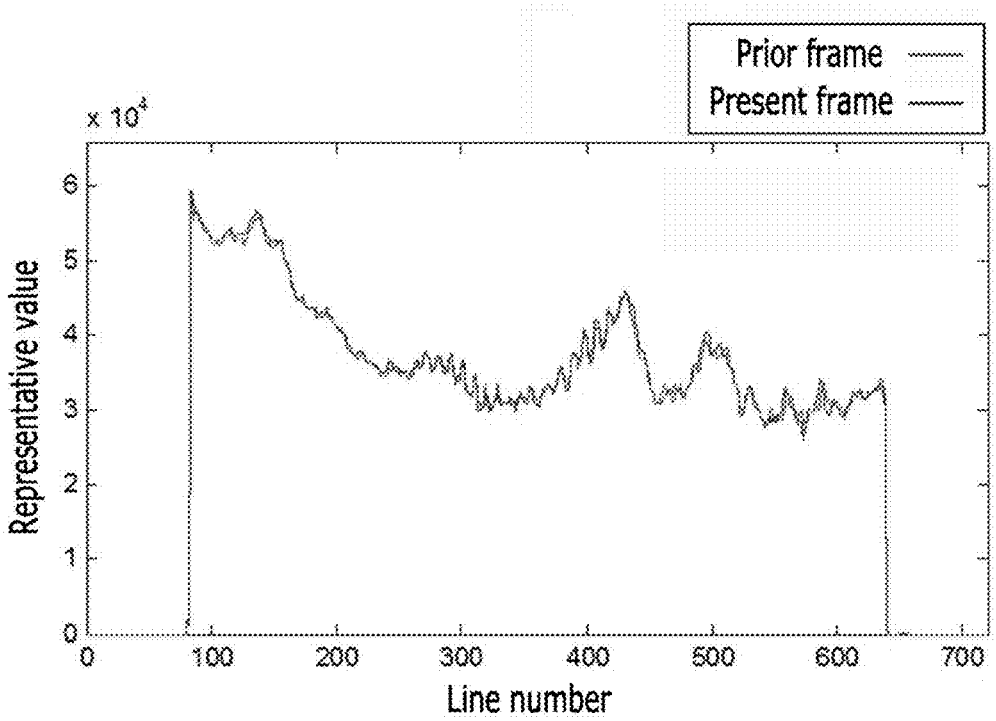
FIG. 4 is a graph showing representative value versus line number of two adjacent frames when a motion picture is displayed in a comparative embodiment of the display device where the representative value is generated by simply adding up the image data of each line.
Figure 5:
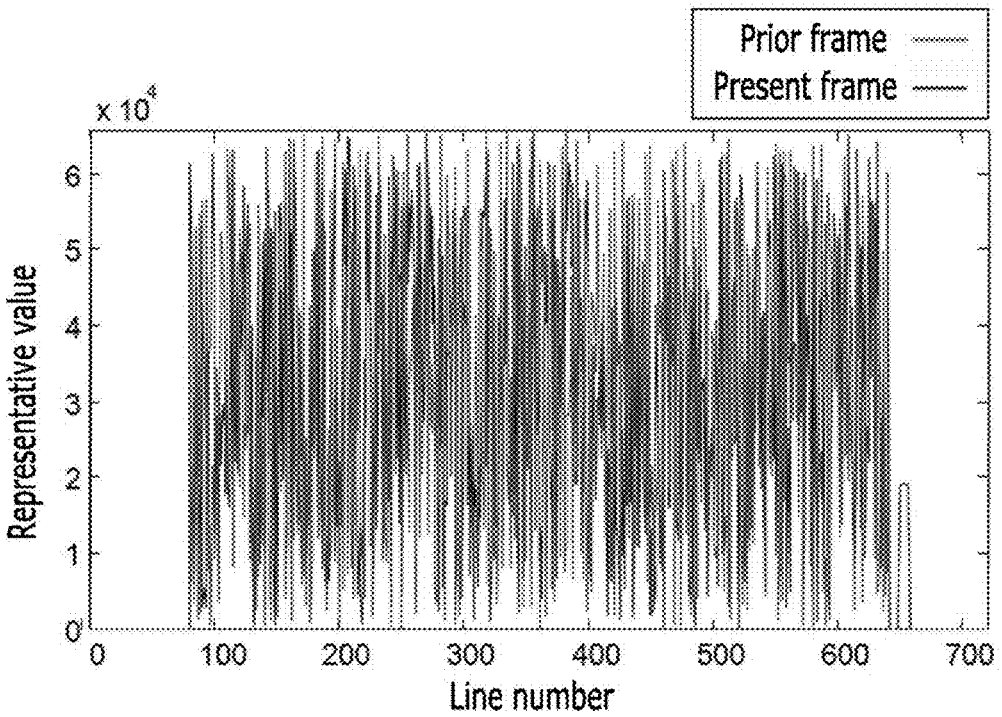
FIG. 5 is a graph showing representative value versus line number of two adjacent frames when a motion picture is displayed in an exemplary embodiment of the display device according to the invention.

FIG. 4 is a graph showing representative value versus line number of two adjacent frames when a motion picture is displayed in a comparative embodiment where the representative value is generated by simply adding up the image data of each line, and FIG. 5 is a graph showing representative value versus line number two adjacent frames when a motion picture is displayed in an exemplary embodiment of the display device according to the invention.

Referring to FIG. 4, in the comparative embodiment, the representative value of the prior frame and the representative value of the present frame are substantially similar as each other for each line. When the motion picture is displayed, since the image is not instantaneously largely changed but rather slowly changed, the images of the two adjacent frames generally have substantially similar image data. Accordingly, when the image data of each pixel are changed in the two adjacent frames, the representative values of the corresponding lines in the comparative embodiment may be substantially the same as each other, as shown in FIG. 4.

When there is a difference between the image data of the prior frame and the present frame in two pixels, differences between the image data of the prior frame and the present frame in two pixels may have substantially the same absolute value, and may be offset from each other. In this case, since the representative value of the prior frame and the representative value of the present frame have substantially the same value even though the motion picture is displayed, there an error may occur an error such that the motion picture is determined to be the still image.

Referring to FIG. 5, in an exemplary embodiment of the display device according to the invention, the image data of each line are not simply added up, but the representative value may be generated by moving the last position digit to another position digit whenever the addition is performed to reduce a probability of occurrence of the error. In an exemplary embodiment of the display device according to the invention, the representative value of the prior frame and the representative value of the present frame are not similar to each other but are largely different from each other, as shown in FIG. 5.

Ratios of error occurrence in the comparative embodiment and the exemplary embodiment were measured through a motion picture simulation, the error of about 0.18% occurred in the comparative embodiment, and the error of about 0.04% occurred in an exemplary embodiment of the display device according to the invention. The ratio of error occurrence may be reduced by about 0.14%.

Figure 6:
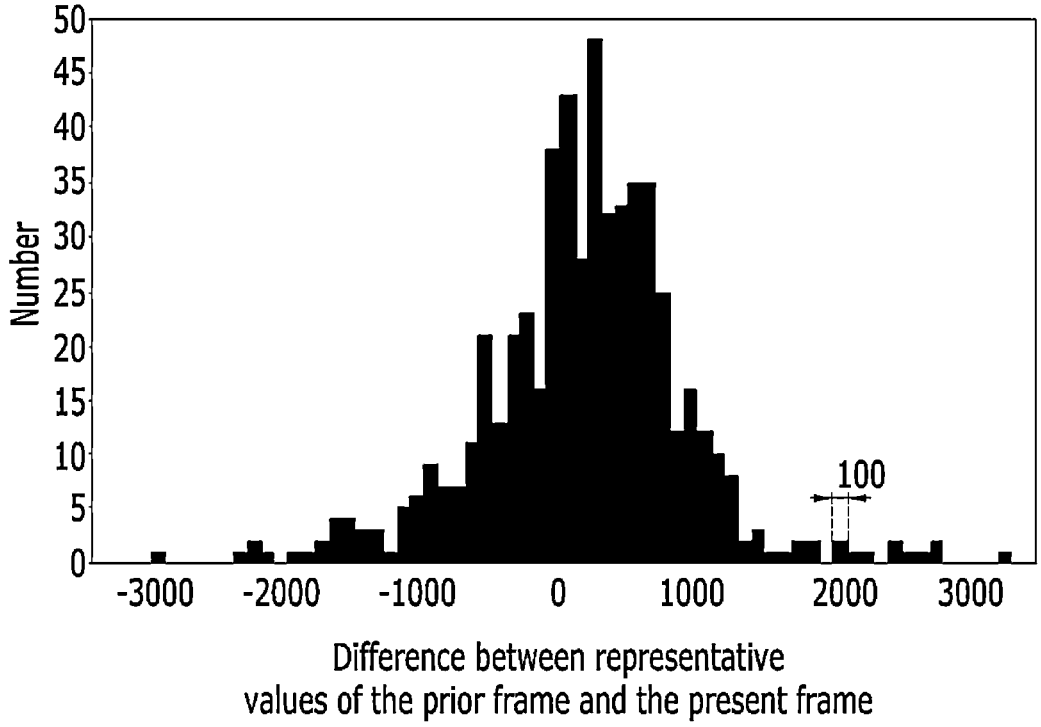
FIG. 6 is a graph showing a difference between the representative values of the two adjacent frames in the comparative embodiment of the display device where the representative value is generated by simply adding up the image data of each line.
Figure 7:
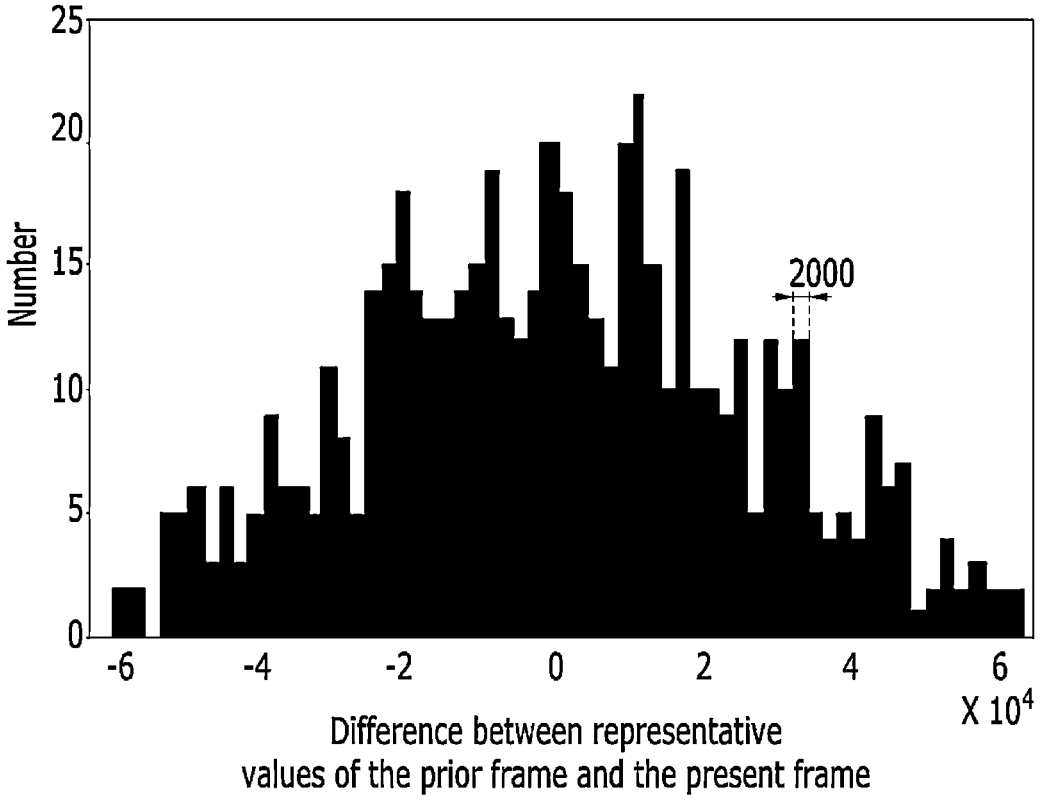
FIG. 7 is a graph showing a difference between the representative values of the two adjacent frames in an exemplary embodiment of the display device according to the invention.

Referring now to FIGS. 6 and 7, a distribution of differences between the representative values in the comparative embodiment and an exemplary embodiment of the display device according to the invention will be described below.

FIG. 6 is a graph showing a distribution of a difference between the representative values of the two adjacent frames in the comparative embodiment where the representative value is generated by simply adding up the image data of each line, and FIG. 7 is a graph showing a distribution of a difference between the representative values of the two adjacent frames in an exemplary embodiment of the display device according to the invention.

Referring to FIG. 6, in the comparative embodiment, the case where the difference between the representative values of the two adjacent frames is substantially close to zero (0) substantially frequently occurs as compared to other cases where the difference between the representative values of the two adjacent frames is substantially greater than or less than zero (0). As show in a Gaussian distribution of FIG. 6, the number of each difference between the representative values of the two adjacent frames is gradually reduced as the difference between the representative values of the two adjacent frames goes away from zero (0), and the distribution of the difference is in a range from about −3,000 to about 3,000.

That is, since the difference between the representative values of the two adjacent frames may not be substantially greater than zero (0), but the difference is frequently substantially close to zero (0), there is a high probability of misjudging that the still image is displayed even when the motion picture is displayed.

Referring to FIG. 7, in an exemplary embodiment of the display device according to the invention, differences between the representative values of the two adjacent frames are relatively uniformly distributed. In the distribution of FIG. 7, the difference between the representative values of the two adjacent frames has a relatively wide range, which is from about −60,000 to about 60,000.

In such an embodiment, since a substantial portion of the differences between the representative values of the two adjacent frames are substantially greater than and are not close to zero (0), a probability of error occurrence is substantially reduced.

Next, referring to FIGS. 1, 2, 8 and 9, an alternative exemplary embodiment of the display device according to the invention will be described below.

Figure 8:
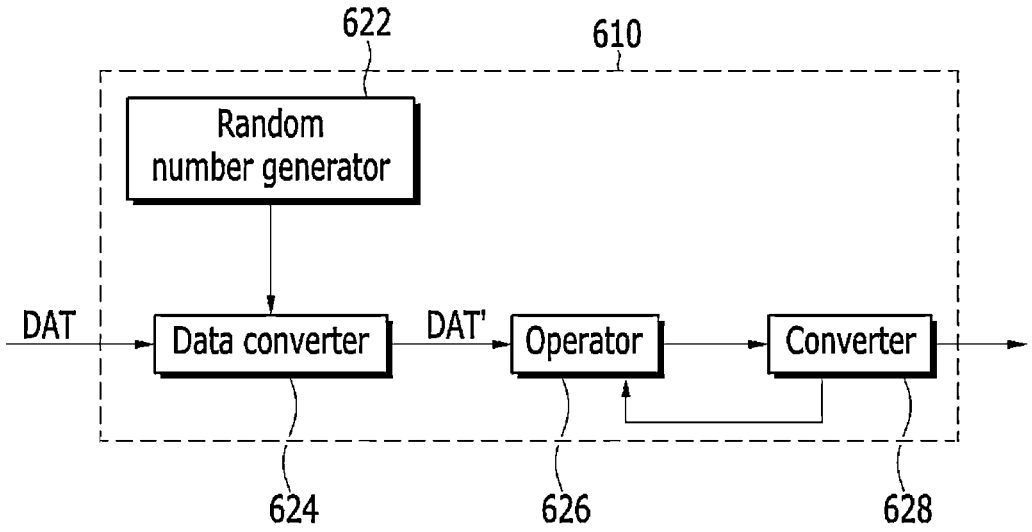
FIG. 8 is a block diagram showing an alternative exemplary embodiment of a representative value generator of a signal controller of a display device according to the invention.
Figure 9:
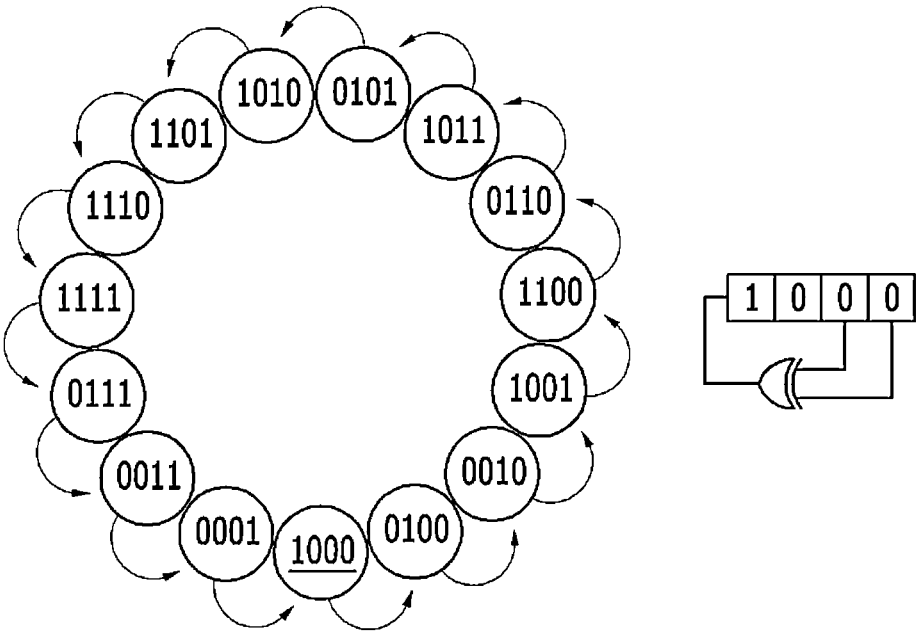
FIG. 9 is a view showing a generation principle of random numbers generated by an exemplary embodiment of a random number generator of the representative value generator of the signal controller of the display device according to the invention.

FIG. 8 is a block diagram showing an alternative exemplary embodiment of a representative value generator of a signal controller of a display device according to the invention, and FIG. 9 is a view showing a generation principle of random numbers generated by an exemplary embodiment of a random number generator of the representative value generator of the signal controller of the display device according to the invention.

The exemplary embodiment of the display device in FIG. 8 is substantially the same as the exemplary embodiment of the display device shown in FIGS. 1 to 2 except for the representative value generator. The same or like elements shown in FIG. 8 have been labeled with the same reference characters as used above to describe the exemplary embodiment of the display device shown in FIGS. 1 to 2, and any repetitive detailed description thereof will hereinafter be omitted or simplified.

An alternative exemplary embodiment of the display device according to the invention includes the display panel 300 and the signal controller 600, as in the exemplary embodiment shown in FIG. 1. In such an embodiment, the signal controller 600 includes the representative value generator 610, the storage portion 630 and the comparator 650, as in the exemplary embodiment shown in FIG. 2.

Referring to FIG. 8, the representative value generator 610 includes a random number generator 622 that generates a random number, a data converter 624 that combines image data DAT inputted from outside with the random number to generate converted image data DAT', an operator 626 that sequentially operates the converted image data DAT' to generate the middle value, and a converter 628 that changes the last position digit of the middle value into another position digit to generate the changed value.

Referring to FIG. 9, the random number generator 622 may generate the random number using a linear feedback shift register ("LFSR").

The linear feedback shift register is a type of shift register, and has a structure that the value inputted to the register is operated by a linear function of values of the prior state. In an exemplary embodiment, the linear function may be an exclusive OR (XOR). An initial value of the LFSR is referred to as a seed.

In the operation of the LFSR, which is deterministic, a sequence of values generated by the LFSR is determined by the prior values. In the LFSR, the number of the available values for the register is limited, and the operation of the LFSR has a sequence repeated at a predetermined interval. However, depending on the linear function, the sequence may have a substantially long interval such that random numbers may be generated. The LFSR is typically used in fields such as a pseudo-random number, a pseudo-random number noise ("PRN"), a rapid digital counter and a whitened sequence.

In one exemplary embodiment, for example, the random number generator 622 may generate 15 random numbers having four position digits using the value of 1000 as the seed. First, zero (0) that is an output value obtained by inputting the last two position digits of the seed to the exclusive OR gate (XOR) is moved to the first position digit of the seed, and the last position digit of the seed is deleted to generate a value of 0100 as the random number. Subsequently, zero (0) that is an output value obtained by inputting the last two position digits of 0100 to the exclusive OR gate is moved to the first position digit, and the last position digit is deleted to generate a value of 0010 as the random number. The output value obtained by inputting the last two position digits to the exclusive OR gate is moved to the first position digit of the seed by the same manner, and the last position digit is deleted to generate total 15 random numbers.

In an alternative exemplary embodiment, the seed may a value other than 1000, and the number of digit positions of the seed may vary. In an exemplary embodiment, the number of digit positions of the seed may be set to be the same as the number of digit positions of the input image data DAT. In one exemplary embodiment, for example, where the input image data DAT is 4 bit, the seed may be set to be 4 bit. In an alternative exemplary embodiment, where the input image data DAT is 6 bit, the seed may be set to be 6 bit. In an exemplary embodiment, the number of digit positions of the random number generated in the random number generator 622 is set to be the same as the number of digit positions of the input image data DAT.

In an exemplary embodiment, as described above, the output value is generated by inputting the last two position digits of the seed to the exclusive OR gate, but not being limited thereto. In an exemplary embodiment, the output value may be generated by inputting predetermined two different position digits to the exclusive OR gate. In an exemplary embodiment, as described above, the output value obtained by inputting to the exclusive OR gate is moved to the first position digit, but not being limited thereto. In an alternative exemplary embodiment, the output value may be moved to another position digit other than the first position digit.

The data converter 624 receives the input image data DAT from outside, receives the random number from the random number generator 622, and combines the input image data and the random number with each other to generate a converted image data DAT'. The converted image data DAT' are generated using the output value obtained by inputting each position digit of the input image data DAT and each position digit of the random number to the exclusive OR gate. The output value obtained by inputting the first position digit of the input image data DAT and the first position digit of the random number to the exclusive OR gate may be set to be the first position digit of the converted image data DAT', and the output value obtained by inputting the last position digit of the input image data DAT and the last position digit of the random number to the exclusive OR gate may be set to be the last position digit of the converted image data DAT'.

In an exemplary embodiment, two random numbers used to generate the converted image data DAT' of the two adjacent pixels have different values. The generated representative value may be substantially randomly changed using different random numbers to generate the converted image data DAT' of the two adjacent pixels.

In an exemplary embodiment, two random numbers used to generate the converted image data DAT' of the same pixel in the two adjacent frames have the same value. In such an embodiment, where the images of the two adjacent frames are the same as each other, the generated representative values become the same as each other.

In an exemplary embodiment, the operator 626 receives at least a portion of the converted image data DAT' of one frame from the data converter 624 and sequentially adds the converted image data to generate the middle value, and transfers the middle value to the converter 628. In such an embodiment, a changed value of the middle value is received from the converter 628, and the converted image data DAT' are then added to the changed value of the middle value to generate the middle value.

The converter 628 sequentially receives the middle values from the operator 626 and changes the last position digit of the middle value into another position digit to generate the changed value, and transfers the changed value to the operator 626.

Referring again to FIG. 2, the storage portion 630 receives the representative value from the representative value generator 610 and stores the representative value, and the comparator 650 compares the representative value of the present frame and the representative value of the prior frame to each other to determine whether the image of the region represented by the representative value is the still image or the motion picture.

The signal controller 600 controls the driving frequency when the still image is displayed to be lower than the driving frequency when the motion picture is displayed based on the determination result of the comparator 650.

Next, referring again to FIGS. 1, 2, and 8, an alternative exemplary embodiment of the driving method of the display device according to the invention will be described in detail.

First, the signal controller sequentially receives the input image data DAT of one frame. In one exemplary embodiment, for example, the input image data DAT of Table 2 may be sequentially applied to the signal controller 600.

Table 2 shows a portion of the input image data DAT of one frame and the converted image data DAT' generated by combining a portion of the input image data with the random number. A plurality of input image data DAT shown in Table 2 is all the input image data DAT of the same line. That is, Table 2 shows a portion of the input image data DAT sequentially inputted to one line.

TABLE 2

| Input image data DAT | Random number | Converted image data DAT' |
|---|---|---|
| 1011 | 1000 | 0011 |
| 1001 | 0100 | 1101 |
| 1000 | 0010 | 1010 |
| 1101 | 1001 | 0100 |

The random number generator 622 generates a plurality of random numbers and transfers the random numbers to the data converter 624. The random number generator 622 may generate the random number using the LFSR, and the generated random number have position digits the same as the position digits of the input image data DAT.

In an exemplary embodiment, the data converter 624 receives the input image data DAT from outside, receives the random number from the random number generator 622, and combines the input image data DAT and the random number with each other to generate the converted image data DAT' as shown in Table 2. In such an embodiment, two random numbers used to generate the converted image data DAT' of the two adjacent pixels may have different values.

In one exemplary embodiment, as shown in Table 2, for example, if the input image data DAT of 1011 is inputted and the random number of 1000 is inputted to the data converter 624, the value of zero (0) outputted by inputting 1 and 1 that are the first position digit of the input image data DAT and the random number, respectively, to the exclusive OR gate may be set to be the first position digit of the converted image data DAT'. If zero (0) and zero (0) that are the second position digit of the input image data DAT and the random number, respectively, are inputted to the exclusive OR gate, zero (0) is outputted, and may be set to be the second position digit of the converted image data DAT'. If 1 and zero (0) that are the third position digit of the input image data DAT and the random number, respectively, are inputted to the exclusive OR gate, 1 is outputted, and may be set to be the third position digit of the converted image data DAT'. If 1 and zero (0) that are the fourth position digit are inputted to the exclusive OR gate, 1 is outputted, and may be set to be the fourth position digit of the converted image data DAT'. In such an embodiment, when the input image data DAT is 1011 and the random number is 1000, the generated converted image data DAT' is 0011.

In an exemplary embodiment, if the input image data DAT of 1001 is inputted and the random number of 0100 is inputted to the data converter 624, the value of 1 outputted by inputting 1 and zero (0) that are the first position digit of the input image data DAT and the random number, respectively, to the exclusive OR gate may be set to be the first position digit of the converted image data DAT'. If zero (0) and 1 that are the second position digit of the input image data DAT and the random number, respectively, are inputted to the exclusive OR gate, 1 is outputted, and may be set to be the second position digit of the converted image data DAT'. If zero (0) and zero (0) that are the third position digit of the input image data DAT and the random number, respectively, are inputted to the exclusive OR gate, zero (0) is outputted, and may be set to be the third position digit of the converted image data DAT'. If 1 and zero (0) that are the fourth position digit of the input image data DAT and the random number, respectively, are inputted to the exclusive OR gate, 1 is outputted, and may be set to be the fourth position digit of the converted image data DAT'. In such an embodiment, when the input image data DAT is 1001 and the random number is 0100, the generated converted image data DAT' is 1101.

If the input image data DAT of 1000 is inputted and the random number of 0010 is inputted, the converted image data DAT' of 1010 is generated by the manner described above. If the input image data DAT of 1101 is inputted and the random number of 1001 is inputted, the converted image data DAT' of 0100 is generated.

In an exemplary embodiment, the data converter 624 transfers the generated converted image data DAT' to the operator 626.

As shown in Table 3, the operator 626 sequentially adds the inputted converted image data DAT' to generate the middle value, and the converter 618 receives the middle value and moves the last position digit to another position digit to generate the converted value, and applies the converted value to the operator 616.

Table 3 shows a portion of the converted image data DAT' of one frame, a middle value and a converted value thereof.

TABLE 3

| Converted image data DAT' | Middle value | Converted value |
|---|---|---|
| — | — | 10001100 |
| 0011 | 10001111 | 11000111 |
| 1101 | 11010100 | 01101010 |
| 1010 | 01110100 | 00111010 |
| 0100 | 00111110 | 00011111 |

As shown in Table 3, if the converted image data DAT' of 0011 is inputted to the operator 626 and the converted value generated based on the converted image data DAT' inputted before the converted image data DAT' of 0011 is 10001100, the operator 626 adds 0111 to 10001100 to generate 10001111 as the middle value. The last position digit of the generated middle value is 1. The converter 628 may move 1 that is the last position digit to the first position digit to generate 11000111 as the converted value.

In an exemplary embodiment, the converted image data DAT' of 1101 are inputted to the operator 626, and 11000111 that is the converted value generated based on the converted image data DAT' inputted before the converted image data DAT' of 1101 is inputted. The operator 626 adds 1101 to 11000111 to generate 11010100 as the middle value. The last position digit of the generated middle value is zero (0). The converter 628 may move zero (0) that is the last position digit to the first position digit to generate 01101010 as the converted value.

If the converted image data DAT' of 1010 is inputted, the operator 626 may generate 01110100 as the middle value and the converter 628 may generate 00111010 as the converted value by the same manner as described above. The converted image data DAT' of 0100 is inputted, the operator 626 may generate 00111110 as the middle value and the converter 628 may generate 00011111 as the converted value.

If inputted 0100 is the last converted image data DAT' of the converted image data DAT' of one line, 00011111 that is the converted value finally generated by the converter 628 of the representative value generator 610 is outputted as the representative value.

In an exemplary embodiment, the representative value generator 610 converts the input image data DAT of the next line to generate the converted image data DAT', sequentially adds the converted image data DAT', and changes the last position digit into the first position digit whenever the addition is performed to generate the representative value. The representative value generator 610 generates each of the representative values of the entire lines constituting one frame by the same manner.

In an exemplary embodiment, the storage portion 630 stores the representative values of each line constituting one frame, and the representative value generator 610 sequentially receives the input image data DAT of the next frame to generate the representative values of each line constituting one frame by the aforementioned manner.

In such an embodiment, two random numbers used to generate the converted image data DAT' of the same pixel in the two adjacent frames may have the same value. In such an embodiment, when the random number generator 622 may operate to output the seed as the random number when the input image data DAT of the first pixel of each frame are applied.

In an exemplary embodiment, the representative value generator 610 outputs the generated representative values to the comparator 650, at the same time, the representative values are stored in the storage portion 630, and the storage portion 630 outputs the stored representative values to the comparator 650.

In an exemplary embodiment, the comparator 650 compares the representative value of the prior frame inputted from the storage portion 630 and the representative value of the present frame inputted from the representative value generator 610 to each other for each line. The image of the corresponding line is determined as the still image or the motion picture such that the image is displayed based on the determination result.

In an exemplary embodiment, the switch SW is controlled such that the driving frequency when the still image is displayed is lower than the driving frequency when the motion picture is displayed.

In an exemplary embodiment, the still image or the motion picture is determined for each line of the frame image by generating the representative value of one line of the frame image, but the invention is not limited thereto. In an alternative exemplary embodiment, the representative value of a portion or an entire of the frame image may be generated. In one exemplary embodiment, for example, the representative value of the entire of the frame image of one frame may be generated, or the representative value of a plurality of lines of the frame image of one frame may be generated.

Next, referring to FIGS. 10 to 13, the input image data and the converted image data generated in an exemplary embodiment of the display device according to the invention will be described in detail.

Figure 10:
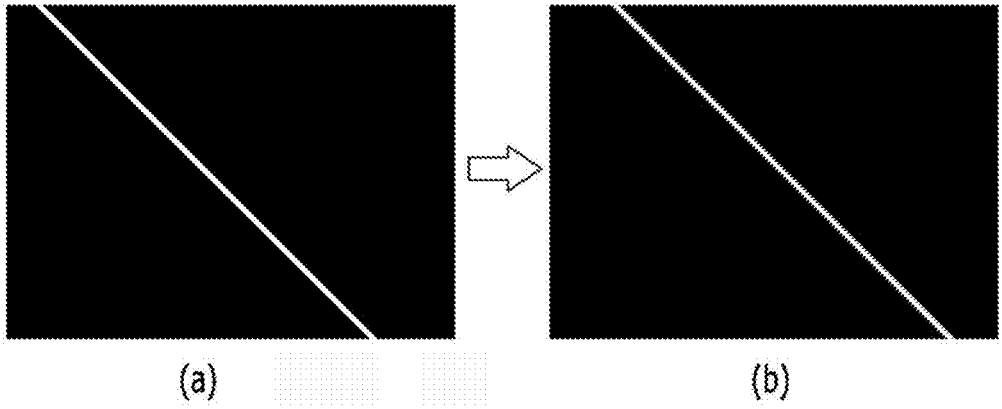
FIG. 10 is a view showing a screen displaying input image data of the two adjacent frames inputted to the display device without conversion.
Figure 11:
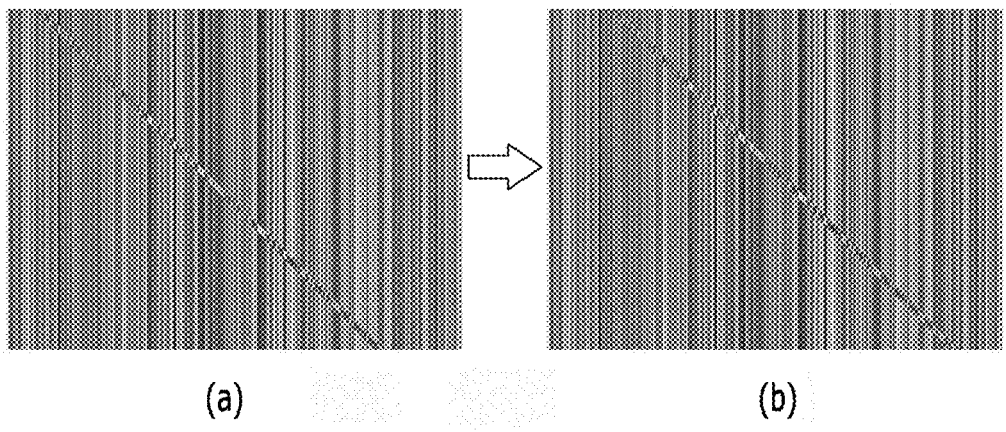
FIG. 11 is a view showing a screen displaying converted image data of two adjacent frames, which are obtained by converting the input image data of FIG. 10.
Figure 12:
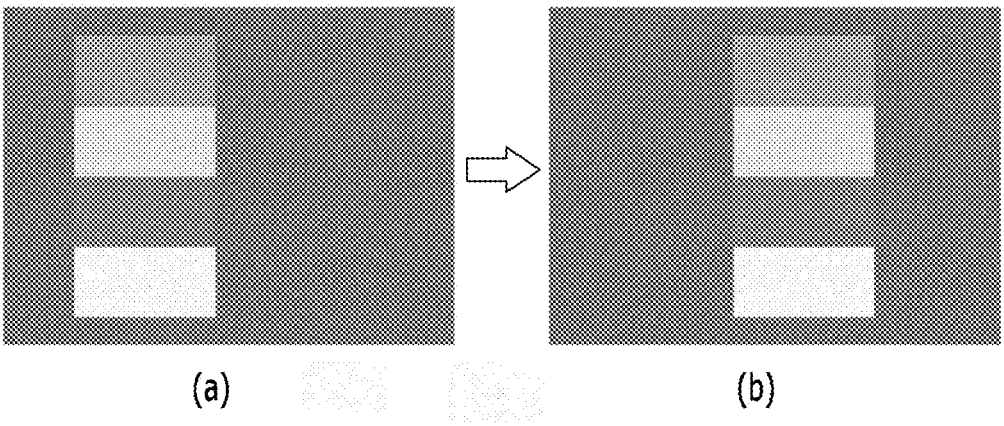
FIG. 12 is a view showing a screen displaying input image data of the two adjacent frames inputted to the display device without conversion.
Figure 13:
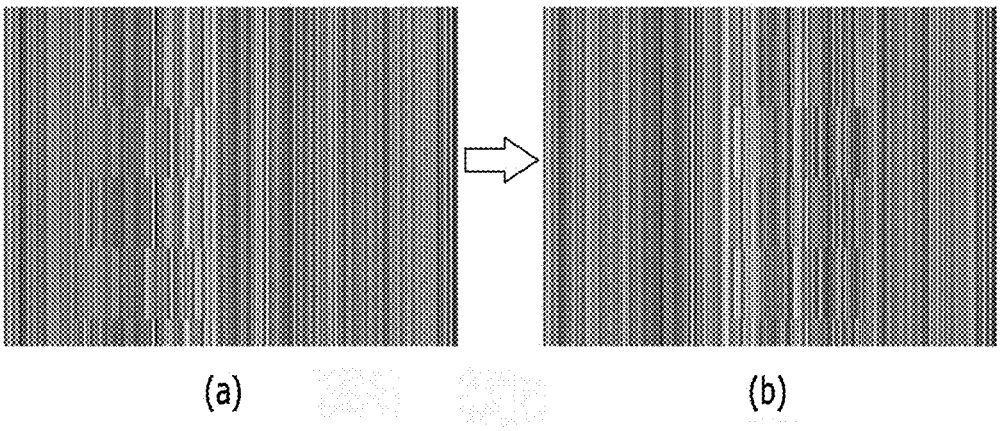
FIG. 13 is a view showing a screen displaying converted image data of the two adjacent frames obtained by converting the input image data of FIG. 12.

FIGS. 10 and 12 are views showing a screen displaying input image data of the two adjacent frames when the input image data are inputted without conversion to an exemplary embodiment of the display device according to the invention, and FIGS. 11 and 13 are views showing a screen displaying the converted image data when the converted image data obtained by converting the input image data of FIGS. 10 and 12 are inputted to the exemplary embodiment of the display device.

First, referring to FIG. 10, a screen where white diagonal lines are drawn in a black background is displayed in the prior frame, and a screen where the white diagonal lines are moved to the right is displayed in the present frame. Since the white diagonal lines are moved in the two adjacent frames, the motion picture is displayed.

Referring to FIG. 11, the black ground portion is converted into different gray levels. As shown in FIG. 11, the white ground portion is converted into different gray levels. However, the pixels that display the same image in the prior frame and the present frame have the same gray level in the prior frame and the present frame.

In an exemplary embodiment, where the representative value is generated using the input image data shown in FIG. 10 by the same manner as the exemplary embodiment shown in FIGS. 1 to 3, the image may be determined to be the still image when the images of the two adjacent frames are different from each other. In one exemplary embodiment, for example, where the representative value having 16 position digits is generated in a screen having resolution of 640×480, if the white diagonal lines are moved to the right by 48 pixels, the representative value of the first line has the same value of 0001101011100101 in the prior frame and the present frame.

In such an embodiment, the representative value of one line may have the same value in the prior frame and the present frame when the diagonal pattern is moved by multiples of 16 pixels. In such an embodiment, if the representative value having 20 position digits is used, the representative value of one line may have the same value in the prior frame and the present frame when the diagonal pattern is moved by multiples of 20 pixels.

In an exemplary embodiment, where the representative value is generated using the converted image data shown in FIG. 11 by the same manner as the exemplary embodiment of FIGS. 1, 2, 8 and 9, the representative values of the two adjacent frames are different from each other and the image may be determined to be the motion picture. In one exemplary embodiment, for example, where the white diagonal line is moved by 48 pixels in a screen having resolution of 640×480, the representative value of the first line in the prior frame is 0000110000100111 and the representative value of the first line in the present frame is 1111011111111100, such that the representative values have different values.

Next, FIGS. 12 and 13 show different image patterns from FIGS. 10 and 11.

In an exemplary embodiment, where the representative value is generated using the input image data shown in FIG. 12 by the same manner as the exemplary embodiment of FIGS. 1 to 3, the image may be determined to be the still image even though the images of the two adjacent frames are different from each other. In one exemplary embodiment, for example, where the representative value having 16 position digits is generated in a screen having resolution of 640×480, if blocks having four different colors are moved to the right by 160 pixels, the representative value of the 400th line has the same value of 1101000000101111 in the prior frame and the present frame.

In such an embodiment, the representative value of one line may have the same value in the prior frame and the present frame when the block pattern is moved by multiples of 16. In such an embodiment, if the representative value having 20 position digits is used, the same representative value is obtained in the prior frame and the present frame whenever the block pattern is moved by multiples of 20.

In the case where the representative value is generated using the converted image data shown in FIG. 13 by the same manner as the exemplary embodiment of FIGS. 1, 2, 8 and 9, the representative values of the two adjacent frames are different from each other and the image may be determined to be the motion picture. In one exemplary embodiment, for example, where blocks having four different colors are moved to the right by 160 pixels in a screen having resolution of 640×480, the representative value of the 400th line in the prior frame is 1000111101101110 and the representative value of the 400th line in the present frame is 1100100110110011, such that the representative values have different values.

In an exemplary embodiment of the invention, where the representative value generator includes random number generator, a ratio of error occurrence is substantially reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel; and a signal controller which controls signals for driving the display panel, wherein the signal controller comprises:

a representative value generator which sequentially operates at least a portion of image data of one frame, wherein the representative value generator moves a last position digit into another position digit of the at least a portion of the image data of the one frame and generates a representative value representing at least a portion of a frame image corresponding to the at least a portion of the image data of the one frame;

a storage portion which stores the representative value therein; and a comparator which compares the representative value of a present frame and the representative value of a prior frame to determine whether the at least a portion of the frame image is a still image or a motion picture, and the signal controller controls the signals for driving the display panel such that a driving frequency when the at least a portion of the frame image is the still image is lower than a driving frequency when the at least the portion of the frame image is the motion picture.

2. The display device of claim 1, wherein the representative value generator comprises:

an operator which sequentially generates a middle value based on the at least a portion of the image data of the one frame; and a converter which moves a last position digit of the middle value to a first position digit to generate a changed value, and transfers the changed value to the operator, wherein the operator generates the middle value using the changed value transferred from the converter based on the at least a portion of the image data of the one frame, wherein the operator performs at least one of an addition and a subtraction, and wherein the converter outputs the changed value as the representative value when an operation of the operator is completed.

3. The display device of claim 2, wherein the representative value generator further comprises:

a random number generator which generates a random number; and a data converter which generates converted image data by combining input image data received from outside with the random number, and the operator generates the middle value based on the converted image data.

4. The display device of claim 3, wherein the random number generator generates the random number using a linear feedback shift register.

5. The display device of claim 4, wherein the random number generator generates a first random number by moving an output value obtained by inputting last two position digits of a predetermined number to an exclusive OR gate to a first position digit of the predetermined number, and deleting a last position digit of the predetermined number, and the random number generator generates a second random number by moving an output value obtained by inputting last two position digits of the first random number to the exclusive OR gate to a first position digit of the first random number, and deleting a last position digit of the first random number.

6. The display device of claim 3, wherein the random number generator generates a plurality of random numbers having the same number of position digits as the input image data.

7. The display device of claim 6, wherein the data converter generates the converted image data using an output value obtained by inputting each position digit of the at least a portion of the input image data and each position digit of the random number to an exclusive OR gate.

8. The display device of claim 6, wherein two random numbers used to generate the converted image data of two adjacent pixels in a same frame have different values, and two random numbers used to generate the converted image data of a same pixel in two adjacent frames have a same value.

9. The display device of claim 1, wherein the signal controller further comprises a switching portion which is turned on when the at least the portion of the frame image is the motion picture.

10. The display device of claim 1, wherein the at least a portion of the image data of the one frame corresponds to one line of the frame image or an entire of the frame image.

11. A driving method of a display device, the method comprising:

generating a first representative value representing at least a portion of a frame image corresponding to at least a portion of image data of a first frame by sequentially operating based on the at least a portion of the image data of the first frame and moving a last position digit into another position digit;

storing the first representative value;

generating a second representative value representing at least a portion of the frame image corresponding to at least a portion of image data of a second frame by sequentially operating based on the at least a portion of the image data of the second frame and moving the last position digit into another position digit; and determining the at least a portion of the frame image to be a still image when the first representative value and the second representative value are the same as each other and determining the at least a portion of the frame image to be a motion picture when the first representative value and the second representative value are different from each other by comparing the first representative value and the second representative value to each other, wherein a driving frequency of the display device when the at least a portion of the frame image is the still image is controlled to be lower than a driving frequency of the display device when the at least a portion of the frame image is the motion picture.

12. The driving method of a display device of claim 11, wherein each of the generating the first representative value and the generating the second representative value comprises:

moving the last position digit into a first position digit; and performing at least one of an addition and a subtraction.

13. The driving method of a display device of claim 12, wherein each of the generating the first representative value and the generating the second representative value further comprises:

generating a random number; and generating converted image data by combining the at least a portion of the image data with the random number.

14. The driving method of a display device of claim 13, wherein the generating the random number comprises using a linear feedback shift register.

15. The driving method of a display device of claim 14, wherein the generating the random number further comprises:

generating a first random number by moving an output value obtained by inputting last two position digits of a predetermined number to an exclusive OR gate to a first position digit of the predetermined number, and deleting a last position digit of the predetermined number; and generating a second random number by moving an output value obtained by inputting last two position digits of the first random number to the exclusive OR gate to a first position digit of the first random number, and deleting a last position digit of the first random number.

16. The driving method of a display device of claim 13, wherein the generating the random number comprises:

generating a plurality of random numbers, wherein the random numbers have the same number of position digits as an input image data of the display device.

17. The driving method of a display device of claim 16, wherein the generating the converted image data comprises obtaining an output value by inputting each position digit of the input image data and each position digit of the random number to an exclusive OR gate.

18. The driving method of a display device of claim 16, wherein two random numbers used to generate the converted image data of two adjacent pixels have different values, and two random numbers used to generate the converted image data of a same pixel in two adjacent frames have a same value.

19. The driving method of a display device of claim 11, further comprising:

outputting the image data of the second frame when the at least a portion of the frame image is the motion picture.

20. The driving method of a display device of claim 11, wherein the at least a portion of the image data correspond to one line of the frame image or an entire of the frame image.

* * * * *